US006474845B1

(12) United States Patent
Mabe et al.

(10) Patent No.: US 6,474,845 B1
(45) Date of Patent: Nov. 5, 2002

(54) VEHICLE LAMP HAVING A REFLECTIVE CONTAINING FILM COATING ALUMINUM FLAKES

(75) Inventors: Michihiro Mabe, Shizuoka (JP); Koichi Nakamura, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/296,131

(22) Filed: Apr. 22, 1999

(30) Foreign Application Priority Data

Apr. 22, 1998 (JP) ..... 10-111620

(51) Int. Cl.[7] ..... F21V 7/00

(52) U.S. Cl. ..... 362/296; 362/297; 362/346; 362/516; 362/518; 362/310

(58) Field of Search ..... 362/296, 297, 362/346, 516, 518, 310; 359/883, 884, 839; 313/479

(56) References Cited

U.S. PATENT DOCUMENTS 3,932,780 A 1/1976 DeCaro et al.
4,287,231 A * 9/1981 DeCaro et al. ..... 427/106
4,916,585 A 4/1990 Nino ..... 362/61
5,169,229 A * 12/1992 Hopper et al. ..... 362/293
5,582,481 A * 12/1996 Natsume ..... 362/336
6,045,245 A * 4/2000 Kanou ..... 362/518

* cited by examiner

*Primary Examiner*—Stephen Husar
*Assistant Examiner*—Bertrand Zeade
(74) *Attorney, Agent, or Firm*—Sughrue Mion, PLLC

(57) ABSTRACT

A vehicle lamp is fitted with a reflective coated reflector which is capable of obtaining a greater center luminous intensity than conventional reflective coated reflectors. The vehicle lamp includes a light source, a reflector for reflecting light from the light source, and a front lens disposed in front of the light source. The reflective surface of the reflector is formed with a luminance reflective coating film containing aluminum flakes that are arranged so as to have a center luminous intensity of 8,000 cd or greater. An aluminum flake layer with the aluminum flakes piled up therein is formed in the surface layer portion of the luminance reflective coating film, and the aluminum flake layer forms a reflective surface for reflecting light. The aluminum flakes mixed in the luminance reflective coating film are thinner (0.01–0.06 $\mu$m thick) than the aluminum flakes (0.1 $\mu$m or greater in thickness) mixed in a conventional reflective coating film. The aluminum flake layer is uniformly extended along the surface of the reflective coating film and the surface of the luminous intensity layer is smooth, so that the specular reflectance provides for a center luminous intensity of 8,000–13,000 cd.

9 Claims, 7 Drawing Sheets

VEHICLE LAMP HAVING A REFLECTIVE CONTAINING FILM COATING ALUMINUM FLAKES

DETAILED DESCRIPTION OF THE INVENTION

1. Technical Field of the Invention

This invention relates to a vehicle lamp having a reflector for reflecting light from a light source and more particularly to a vehicle lamp whose reflector has a reflective surface coated with a reflective coating film containing aluminum flakes.

2. Description of the Related Art

There are generally known reflectors as members for use in forming vehicle lamps such as a reflector made by aluminum deposition provided on the surface of a reflector base so as to form a reflective surface with an aluminum deposited film (hereinafter called an aluminum deposited reflector), and a reflector made by applying a reflective coating to a reflector base so as to form a reflective surface with a reflective coating film (hereinafter called a reflective coated reflector).

As shown in FIG. 7, the aluminum deposited reflector is utilized mainly for a lamp, such as a headlamp, which has a greater luminous intensity because the aluminum deposited reflector has a specular reflectance of 50% or higher (the percentage of reflected rays of light at the incident and reflected angles equal to each other with respect to the incident ray) and a center luminous intensity (the maximum luminous intensity obtained by turning on a bulb of 12 V, 27 W and 400 lm for a parabolic reflector of F25) of 9,000 cd or greater when a predetermined bulb arranged for a parabolic reflector having a configuration of FIG. 8 is lighted.

On the other hand, the reflective coated reflector is utilized for a beacon lamp and the like, which do not have as great a luminous intensity because the reflective coated reflector has a specular reflectance of about 40% or lower and a center luminous intensity of about 8,000 cd or less (200–8,000 cd). As is obvious from FIG. 7, the specular reflectance has a substantially proportional relationship to the center luminous intensity.

Further, although the aluminum deposited reflector provides a greater luminous intensity than the reflective coated reflector, the aluminum deposited reflector is costly because it requires large deposition facilities, many manufacturing steps and a great deal of time for production. On the contrary, although a great luminous intensity is not obtainable with the reflective coated reflector, it is less costly and can be manufactured efficiently, because it only requires simple coating facilities, and the steps of applying a reflective coating prepared by mixing a resin as a binder and aluminum flakes, and adding a volatile solvent to the mixture so as to adjust the viscosity.

In the case of recent beacon lamps such as tail lamps, clearance lamps, turn-signal lamps and the like, the interior of a lamp chamber is arranged so as to be seen through without providing any step for a front lens in order to make the lamps look solid. Consequently, the aluminum deposited reflector offering greater luminance instead of the reflective coated reflector, is employed for emphasizing the solidity. When the luminous intensity is too great for a specific beacon lamp as a result of using the aluminum deposited reflector, applying a smoke top coat onto the aluminum deposited surface or forming an emboss on the reflector base surface where the aluminum deposited film is formed, may be employed for reducing the luminous intensity whereby to provide a lower suitable luminous intensity for the beacon lamp.

Since the luminous intensity obtainable from the conventional reflective coated reflector is limited, such conventional reflective coatings are not used in the aforementioned beacon lamp of the see-through type, and thus, there is a problem arising from the necessity of using the expensive aluminum deposited reflector for a lamp which needs a substantially great luminous intensity.

In the aforementioned beacon lamp of the see-through type, it has been deliberately contrived to decrease the luminous intensity obtainable from the original aluminum deposited film as discussed above, resulting in the problem that the beacon lamp becomes costly to the extent that special labor and time are needed to make a reflector for this purpose.

With respect to the problems above, the present inventor has studied the possibility of increasing the center luminous intensity (specular reflectance) of the reflective coated reflector, as greater luminance may have the effect of providing more solidity and increasing the center luminous intensity (specular reflectance) of the reflective coated reflector without having to contrive a means of lowering the luminous intensity of the reflector.

The reflective coating film used to form the reflective surface of a reflector is structured as shown in FIG. 9(*a*) so that an aluminum flake layer 3 in which aluminum flakes 4 having a mean particle diameter of 3 $\mu$m or greater and a thickness of 0.1 $\mu$m or greater are lined up continuously and formed in the surface layer portion of a resin layer 2 as a binder adhering to the surface of a reflector base 1, the aluminum flake layer 3 forming a reflective surface for reflecting light.

The reflective coated reflector is formed by mixing the resin 2 as a binder and the aluminum flakes 4, and adding a volatile solvent to the mixture so as to adjust the viscosity to a predetermined degree. In order to increase floatability with respect to the resin 2 as a binder, stearic acid is made to adhere to the aluminum flakes 4 in the reflective coating beforehand. Consequently, the aluminum flakes 4 are kept floating within the liquid resin (layer) 2 in the coating (coating film) immediately after the coating is applied to the reflector base 1 as shown in FIG. 9(*b*). As the drying and hardening of the resin (layer) 2 progress, the aluminum flakes 4 are piled up and the aluminum flake layer 3 appears to be formed in the surface layer portion of the film as shown in FIG. 9(*a*).

Therefore, the present inventor reasoned that the center luminous intensity be increased by increasing the smoothness of the surface of the aluminum flake layer 3 and studied a method of increasing the surface smoothness of the aluminum flake layer 3.

First, the size (particle diameter) of the aluminum flakes 4 to be mixed in was reduced. As shown in FIG. 10, the finer (the smaller of the particle diameters) the aluminum flake, the greater the center luminous intensity became to some extent. However, the luminous intensity did not reach 8,000 cd.

Then it was attempted to reduce the thickness of the aluminum flake 4 without changing the size (particle diameter) of the aluminum flake 4 to be mixed in. As shown in FIG. 11, the thinner the aluminum flake 4, the greater the center luminous intensity became. Thus, a center luminous intensity (specular reflectance) of not less than 8,000 cd was obtained, which had previously not been obtainable from any one of the conventional reflective coated reflectors.

Attention was also focussed on the softening point of the resin (layer) 2 as a binder for use in forming the reflective coating film and resins different in the softening point were used. It was proved that the lower the softening point of the resin, the greater the center luminous intensity became (see FIG. 5).

SUMMARY OF THE PRESENT INVENTION

An object of the present invention, in view of the foregoing problems pertaining to the prior art and the present inventor's reasoning, is to provide a vehicle lamp fitted with a reflective coated reflector capable of obtaining a greater center luminous intensity (specular reflectance) that has not been obtainable from conventional reflective coated reflectors.

In order to accomplish the above object, a vehicle lamp comprises a light source, a reflector disposed behind the light source, used to reflect light from the light source forward, and a front lens disposed in front of the light source, wherein the reflective surface of the reflector is formed with a luminance reflective coating film having a center luminous intensity of 8,000–13,000 cd, the luminance reflective coating film being formed by applying a luminance reflective coating to a reflector base and drying the coating, the luminance reflective coating being prepared by mixing a binder and thin aluminum flakes having a thickness of 0.01–0.06 $\mu$m with stearic acid adhering to the flakes, and making the coating have a predetermined viscosity by using a solvent.

An aluminum flake layer with the piled-up aluminum flakes is formed in the surface layer portion of the luminance reflective coating film and this aluminum flake layer forms the reflective surface for reflecting light. Since the aluminum flakes (0.01–0.06 $\mu$m in thickness) mixed in the luminance reflective coating film are thinner than the aluminum flakes (0.1 $\mu$m or greater in thickness) mixed in the conventional reflective coating film, irregularities of the aluminum flake layer are decreased. Moreover, the aluminum flakes are lighter than the bulk aluminum flakes in the luminance reflective coating (film) immediately after being applied to the reflector, and since the stearic acid is sticking onto the surface of each aluminum flake, the aluminum flakes are easily kept afloat within the coating film (the resin layer) and also readily piled up in the surface layer portion of the luminance reflective coating film as the coating film (the resin layer) dries and hardens. Therefore, the aluminum flake layer is extended in uniform thickness along the surface of the luminance reflective coating film, and the surface of the aluminum flake layer is smoothed with the effect of increasing the specular reflectance, whereby a greater center luminous intensity (of 8,000–13,000 cd) that has been unobtainable from the conventional reflective coated reflector can be obtained.

In other words, although uniformity as well as smoothness of the thickness of the aluminum flake layer increases while the thickness of each aluminum flake remains at less than 0.01 $\mu$m, the center luminous intensity (specular reflectance) is decreased because light is caused to pass through the aluminum flakes. If the thickness of each aluminum flake exceeds 0.06 $\mu$m, a gap will be produced between the aluminum flakes in the aluminum flake layer, and the thickness of the aluminum flake layer will lack uniformity, which results in decreasing not only the smoothness of the surface of the aluminum flake layer but also the center luminous intensity (specular reflectance).

If the thickness exceeds 0.06 $\mu$m, the floatability of the aluminum flakes with respect to the resin will lower slightly and the percentage having the aluminum flakes piled up in the surface layer portion will also lower, thus causing the center luminous intensity (specular reflectance) to decrease. Therefore, it is desirable to set the thickness from 0.01 to 0.06 $\mu$m for increasing the center luminous intensity (specular reflectance).

Further, the softening point of a resin which is the binder used to form the luminance reflective coating film should range from 95 to 140° C., and preferably range from 100–120° C.

With respect to forming a uniform aluminum flake layer in the surface layer portion of the luminance reflective coating film by increasing the floatability of the aluminum flakes as one of the factors for increasing the center luminous intensity (specular reflectance), it is preferred that the softening point of the resin layer (resin acting as an aluminum-flake binder) forming the (lower layer portion of the) luminance reflective coating film is lower. If, however, the softening point of the resin is lower than 95° C., the resin layer will become softened when the film temperature reaches over 95° C. and the aluminum flake layer will crack. If the softening point of the resin layer exceeds 140° C., the aluminum flakes will not be able to float satisfactorily in the resin as a binder in the luminance reflective coating film thus applied because the high viscosity of the resin. In addition, the aluminum flakes are intermingled in the resin layer of the hardened luminance reflective coating film and this also results in decreasing the center luminous intensity (specular reflectance). Therefore, the softening point of the resin forming the luminance reflective coating film should preferably be not lower than 95° C. in view of heat resistance and not higher than 140° C. in order to increase the specular reflectance. It is desirable to use a resin as a binder having a softening point of from 100 to 120° C. so as to secure resistance against heat at 95° C. and a center luminous intensity of not less than 100 cd in particular.

In a vehicle lamp, the front lens may be provided with a see-through portion through which the reflective surface of the reflector is seen. Since the reflector with greater luminance is seen through the see-through portion of the front lens, a feeling of depth (solidity) is emphasized.

BRIEF DESCRIPTION OF THE DRAWINGS

The above objects and other advantages of the present invention will become more apparent by describing in detail the preferred embodiments thereof with reference to the attached drawings, in which:

FIG. 3(*b*) an enlarged view of the luminance reflective coating film immediately after the coating is applied;

FIG. 4(*b*) is a diagram illustrating a drying step;

FIG. 8(*b*) is a vertical sectional view of the reflector;

FIG. 8(*c*) a horizontal sectional view of the reflector;

FIG. 9(*b*) an enlarged sectional view of the conventional reflective coating film immediately after the coating is applied;

DESCRIPTION OF THE PREFERRED EMBODIMENTS

Figure 1:
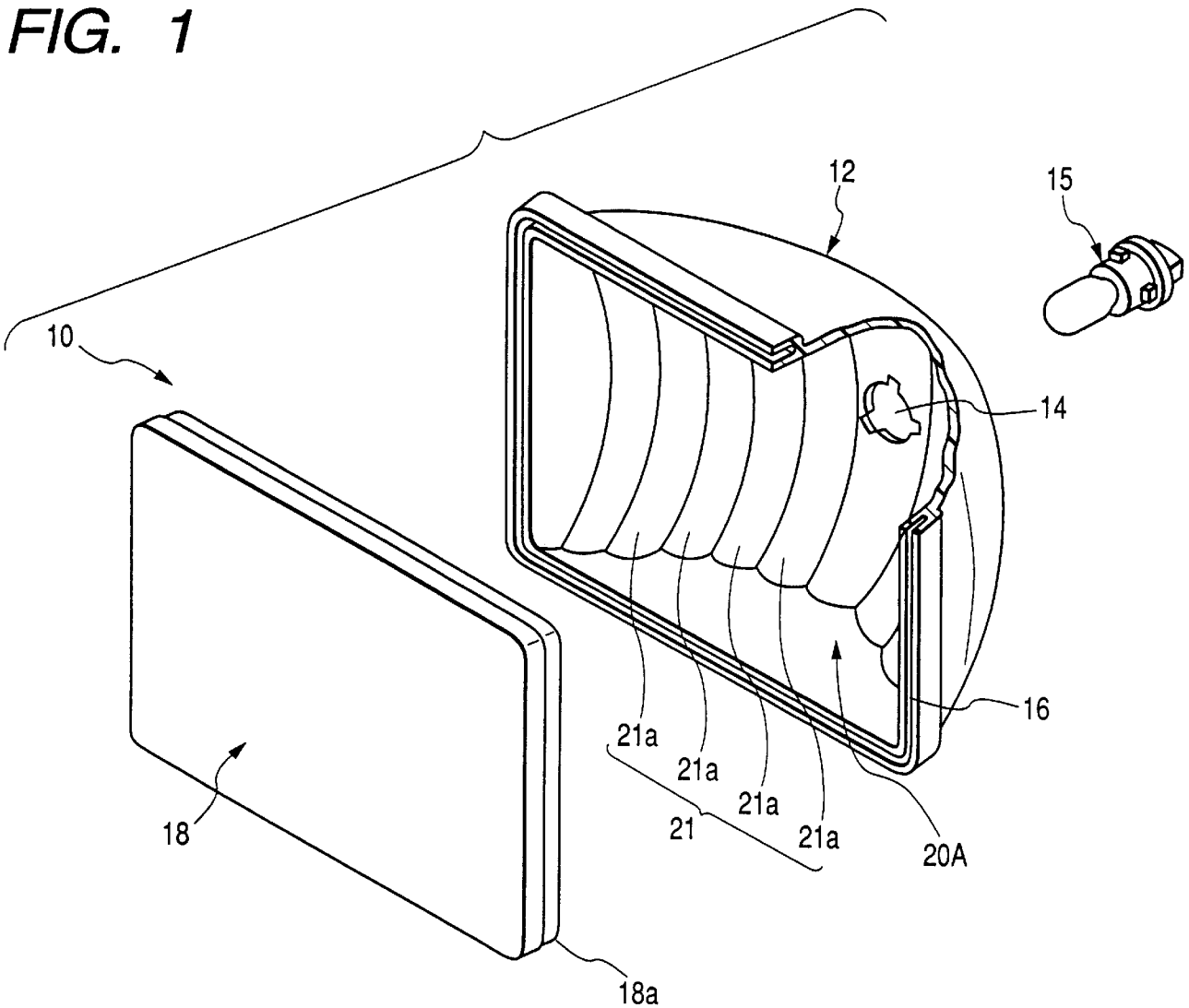
FIG. 1 is an exploded perspective view of an automobile tail lamp as a first embodiment of the invention.
Figure 2:
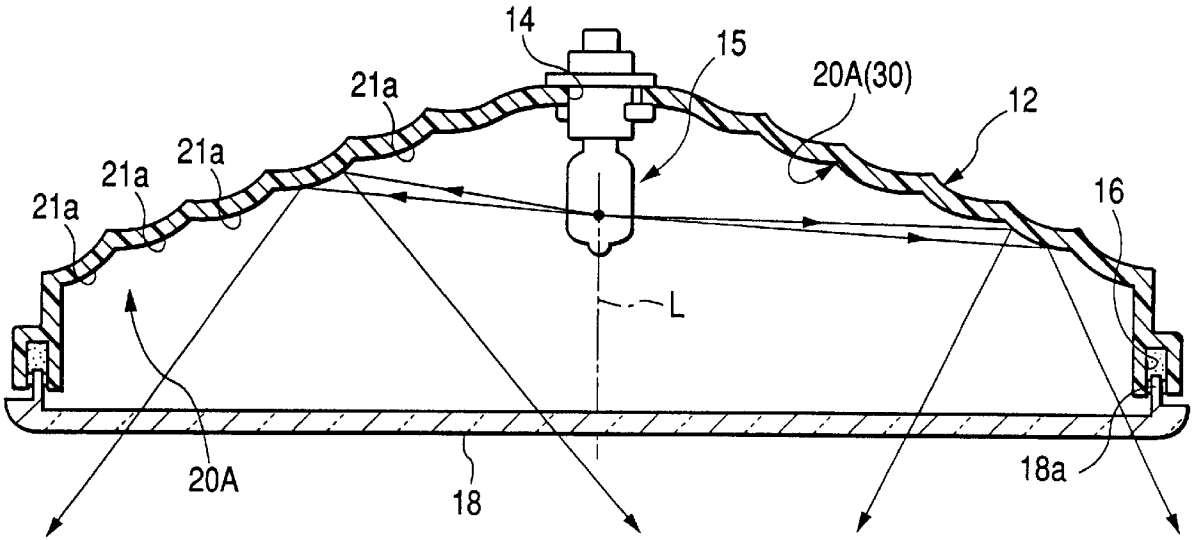
FIG. 2 is a horizontal sectional view of the lamp.
Figure 3A:
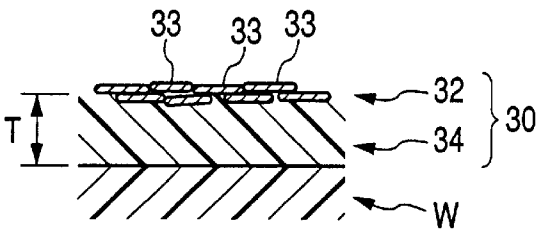
FIG. 3(*a*) is an enlarged view of a luminance reflective coating film.
Figure 3B:
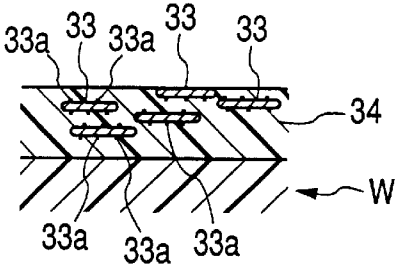
Figure 4A:
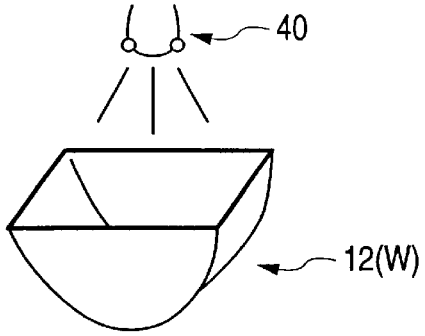
FIG. 4(*a*) is a diagram illustrating a coating step.
Figure 4B:
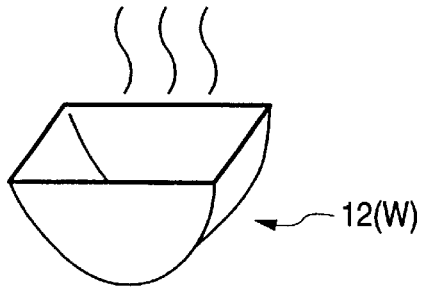

Preferred embodiments of the present invention will now be described. FIGS. 1–5 shown a first embodiment of the invention, wherein FIG. 1 is an exploded perspective view of an automobile tail lamp as the first embodiment thereof; FIG. 2, a horizontal sectional view of the lamp; FIG. 3(*a*), an enlarged view of a luminance reflective coating film; and FIG. 3(*b*), an enlarged view of the luminance reflective coating film immediately after the coating is applied; FIG. 4(*a*), a diagram explanatory of a coating step; and FIG. 4(*b*), a diagram explanatory of a drying step; and FIG. 5, a graph showing the relation between the softening point of a resin as a binder and the center luminous intensity.

In these drawings, reference numeral 10 denotes an automobile tail lamp in which a bulb fitting hole 14 is provided in the rear top portion of a container-like lamp body 12 made of ABS. A bulb 15 is employed as a light source and is fitted into the bulb fitting hole 14. A front lens 18 tinged with red as a functional color for the tail lamp is incorporated in and integrated with the tail lamp 10 by mating a sealing leg 18*a* with a sealing groove 16.

A reflector 20A fitted with an effective reflective surface 21, which together with a luminance reflective coating film 30 contributes to light distribution, is integrally formed on the inside of the lamp body 12. The effective reflective surface 21 is structured so that a plurality of divided effective rectangular reflective surfaces 21*a* extending vertically along the inside of the lamp body 12, are continuously and laterally formed. Each of the divided effective reflective surfaces 21*a* is parabolic in vertical cross section whereby to reflect light in parallel to the optical axis L in the vertical direction and is arcuately convexed forward in horizontal cross section whereby to diffuse light in the lateral direction; in other words, the divided effective reflective surface 21*a* is in the form of a curved convex surface as shown in FIGS. 1 and 2.

A diffusion step, such as a fish-eye step or a cylindrical step, for diffusing emitted light is not provided for the front lens 18, but rather only the function of tingeing the light passed through the lens with red is provided therefor. In other words, it has been so arranged that the distribution of light from the tail lamp is determined only by the effective reflective surface 21 (as configured by the effective rectangular reflective surfaces 21*a*) of the reflector 20A having the predetermined configuration.

Although the whole front lens 18 is tinged with red when the lamp is switched on, the lamp looks solid while the lamp is switched off because (the effective reflective surface 21) of the greater-luminance reflector 20A in a lamp chamber can be seen through the front lens 18 without such a diffusion step.

Aluminum flakes (having a mean particle diameter of 5 $\mu$m and a thickness of 0.05 $\mu$m) are mixed in the luminance reflective coating film 30 used to form the effective reflective surface 21 of the reflector 20A, so that a greater luminous intensity (specular reflectance) that has so far been unobtainable from the conventional reflective coating film becomes obtainable.

More specifically, the luminance reflective coating film 30 having a film thickness of T (e.g., 20–25 $\mu$m) is formed on a reflector base W as shown in FIG. 3(*a*). The film 30 includes an aluminum flake layer 32 formed by piling up aluminum flakes 33, and a petroleum resin 34 having a softening point of 120° C. as a binder for making the aluminum flake layer 32 adhere fast to the reflector base W. The aluminum flake layer 32 extending on the surface layer portion of this reflective coating film 30 forms a reflective surface for reflecting light.

Figure 9A:
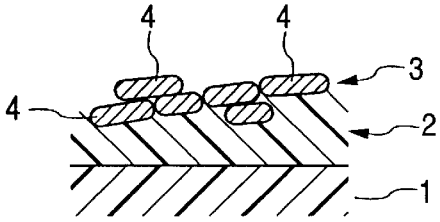
FIG. 9(a) PRIOR ART
FIG. 9(*a*) is an enlarged sectional view of a conventional reflective coating film.
Figure 9B:
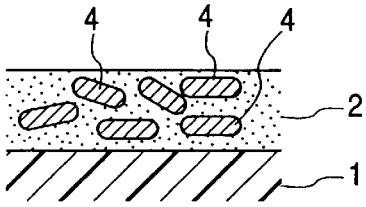
FIG. 9(b) PRIOR ART

The aluminum flakes 33 are thinner (0.05 $\mu$m thick) than the aluminum flakes (0.1 $\mu$m or greater in thickness) mixed in the conventional reflective coating film (see FIG. 9). Consequently, the aluminum flake layer 32 is extended in uniform thickness along the surface of the luminance reflective coating film 30. As the surface of the aluminum flake layer 32 is free of raggedness, the reflective surface is made smooth to the extent that the center luminous intensity (specular reflectance) of the reflective coated reflector is greater than that of the conventional reflective coated reflector.

In order to form the luminance reflective coating film 30 on the surface of the reflector 20A, a luminance reflective coating is prepared by first mixing a resin (a petroleum resin having a softening point of 120° C.) as a binder and a predetermined quantity of aluminum flakes (having a mean particle diameter of 5 $\mu$m and a thickness of 0.05 $\mu$m) with stearic acid adhering to the flakes, and adding a volatile solvent to the mixture so as to adjust the viscosity to a proper level. As shown in FIG. 4(*a*), a spray gun 40 is used to apply the coating to the whole inside of the lamp body 12 (the reflector base W), which is then dried in a drying oven for a predetermined time as shown in FIG. 4(*b*).

In the luminance reflective coating film 30, immediately after the aluminum flakes 33 have been applied to the reflector base W during the step of applying the luminance reflective coating, the aluminum flakes 33 that have obtained great buoyancy because of stearic acid 33*a* adhering to the surfaces are kept floating in the liquid petroleum resin layer 34. As the hardening of the film 30 (the resin layer 34) progresses after the solvent evaporates, the aluminum flakes 33 are piled up in the surface layer portion and integrated with the resin layer 34. Since the resin 34 has a softening point of 120° C. which is comparatively low, the viscosity of the resin 34 also remains low in proportion to the softening point thereof, and the aluminum flakes 33 in the film thus applied easily become afloat in the resin layer 34. Therefore, the thickness of the aluminum flake layer 32 extended in the surface layer portion of the luminance reflective coating film 30 is uniform and its surface is also smooth. Consequently, the lower the softening point of the resin 34 as a binder for use in forming the luminance reflective coating film 30, the greater the center luminous intensity (specular reflectance) becomes (see FIG. 5).

While the softening point of the resin remains at 120° C., the luminance reflective coating film 30 may be heat resistant up to 120° C. and thus, no problem in view of its heat resistance is posed because there is no fear that the temperature inside the lamp chamber of a tail lamp exceeds 120° C.

Figure 6:
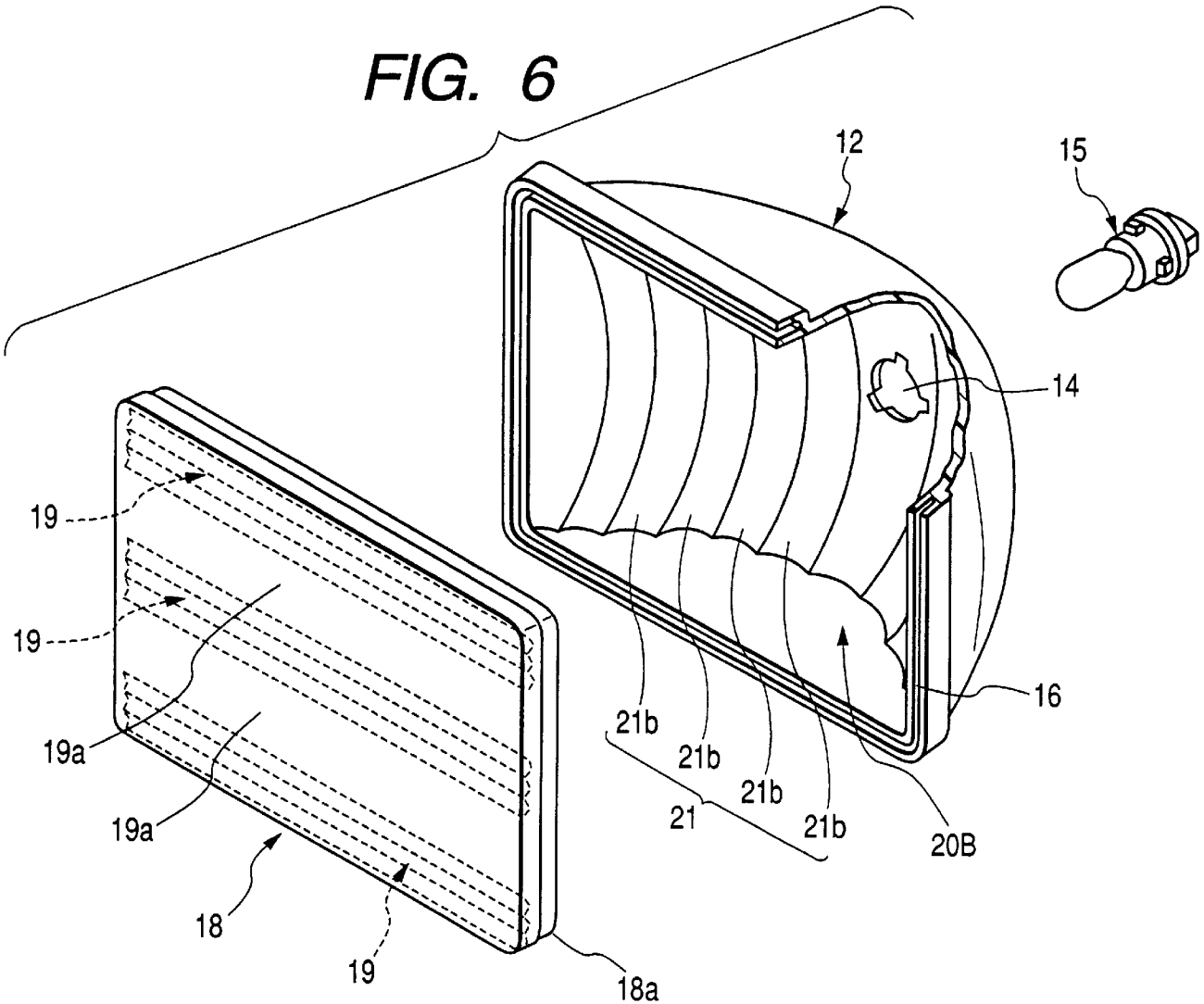
FIG. 6 is an exploded perspective view of a tail lamp in a second embodiment of the invention.
Figure 7:
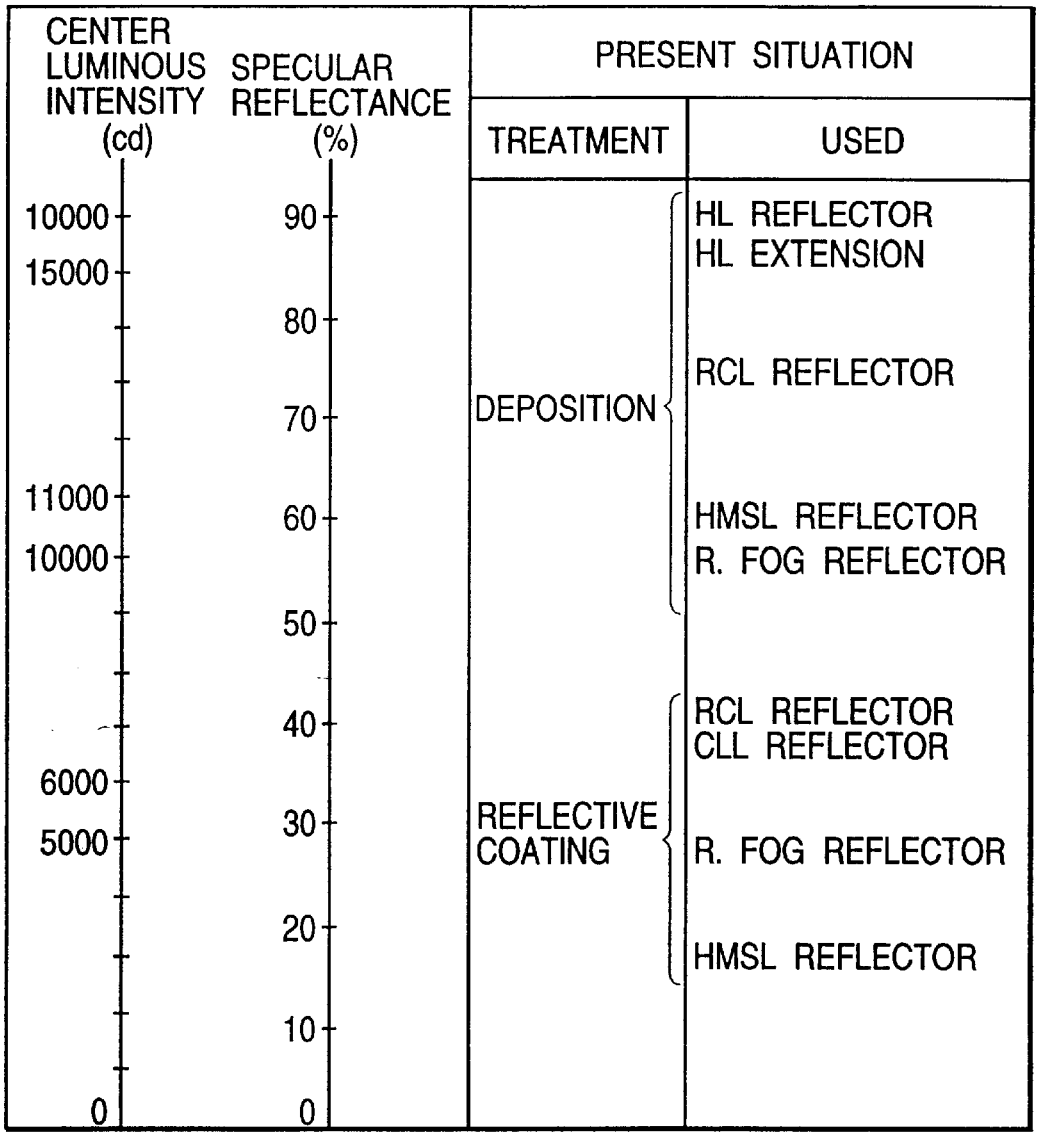
FIG. 7 is a diagram illustrating the center luminous intensity and specular reflectance of an aluminum deposited and a reflective coated reflector.
Figure 8A:
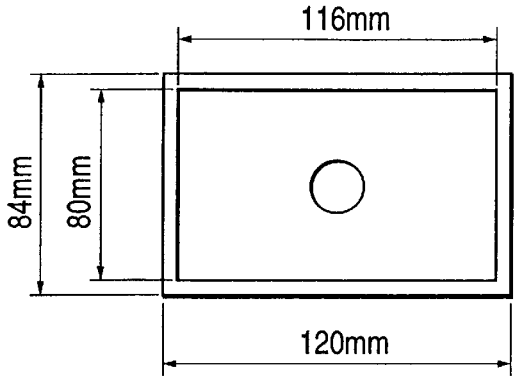
FIG. 8(*a*) is an elevational view of a reflector used to define the center luminous intensity.
Figure 8B:
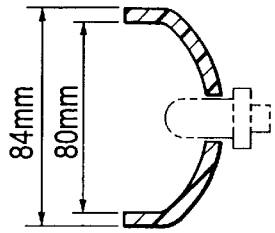
Figure 8C:
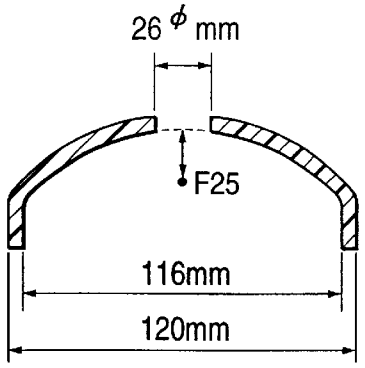

FIG. 6 is an exploded perspective view of a tail lamp as a second embodiment of the invention. Those components of the second embodiment which are identical to those shown in the first embodiment of the invention are given like reference characters, and the description of them will be omitted.

The effective reflective surface 21 (consisting of the divided effective reflective surfaces 21*a*) of the reflector 20A in the first embodiment of the invention is formed into the curved convex surface in horizontal cross section so that light can be reflected and diffused in the lateral direction. On the other hand, the effective reflective surface 21 (divided effective reflective surfaces 21*b*) of a reflector 20B in the second embodiment of the invention is formed into a curved concave (parabolic) surface in vertical cross section as well as horizontal cross section so that light can be reflected in parallel to the optical axis.

Further, a cylindrical step 19 for diffusing the emitted light in the vertical direction is provided vertically in three places on the back of the front lens 18 with each see-through portion 19*a* held between the cylindrical steps 19.

Although a description has been given of a case where each aluminum flake 33 is 0.05 μm thick in the preceding embodiment of the invention, the thickness of the aluminum flake 33 in the range of from 0.01 to 0.06 μm is effective in forming a luminance reflective coating film offering a center luminous intensity of 8,000–13,000 cd.

More specifically, the center luminous intensity (specular reflectance) is reduced when the thickness of the aluminum flakes is less than 0.01 μm because light is caused to pass through the aluminum flakes, though the uniformity of thickness and smoothness of the aluminum flake layer 32 increase. If the thickness of the aluminum flakes 33 exceeds 0.06 μm, not only the surface smoothness of the aluminum flake layer 32 but also the center luminous intensity (specular reflectance) will be reduced because a gap is provided between the adjoining aluminum flakes 33 and 33 and because the thickness of the aluminum flake layer 32 becomes variable. If the thickness exceeds 0.06 μm, the floatability of each aluminum flake 33 with respect to the resin will slightly lower, thus causing the center luminous intensity (specular reflectance) to be reduced. Therefore, it is desirable to range the thickness of the aluminum flakes from 0.01 to 0.06 μm for increasing the center luminous intensity (specular reflectance).

Figure 10:
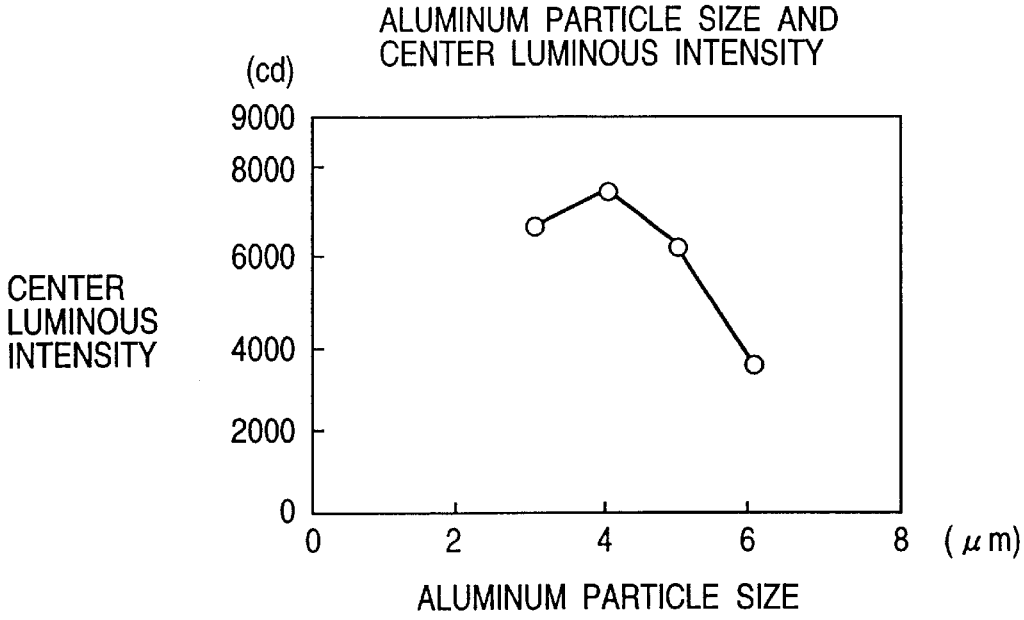
FIG. 10 is a graph showing the relation between aluminum particle diameters and the center luminous intensity.
Figure 11:
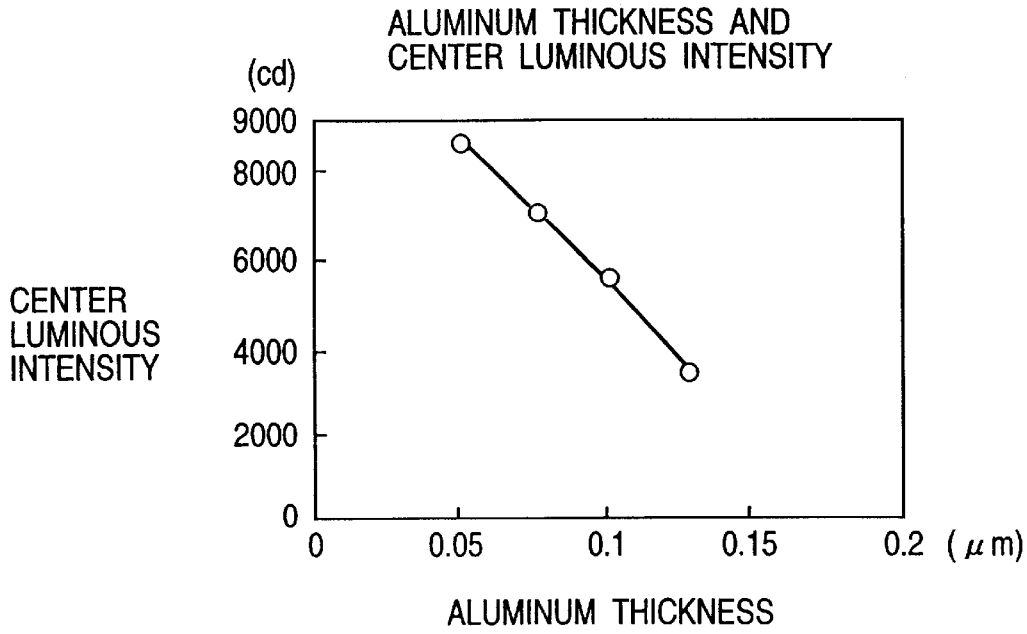
FIG. 11 is a graph showing the relation between the thickness of an aluminum flake and the center luminous intensity.

As the size of each aluminum flake has been defined as 5 μm in terms of the mean particle diameter in the preceding embodiment of the invention, it is preferred to set the size from 2 to 6 μm for making the aluminum flakes easy to handle as shown in FIG. 10, as the center luminous intensity remains unaffected by the particle diameter.

Although the softening point of the resin layer 34 (the resin that acts as an aluminum flake binder) forming (the lower layer portion of) the luminance reflective coating film 30 has been defined as 120° C., the effective softening point of the resin may range from 95 up to 140° C.

More specifically, setting the softening point of the resin at lower than 95° C. will cause the resin layer to soften if the temperature in the lamp chamber rises over 95° C., thus resulting in cracking the aluminum flake layer 32. On the other hand, setting the softening point at higher than 140° C. will cause the aluminum flakes 33 in the resin layer of the hardened luminance reflective coating film to be intermingled because the high viscosity of the resin makes the aluminum flakes 33 unable to float satisfactorily in the luminance reflective coating film applied, thus resulting in decreasing the center luminous intensity (specular reflectance).

Figure 5:
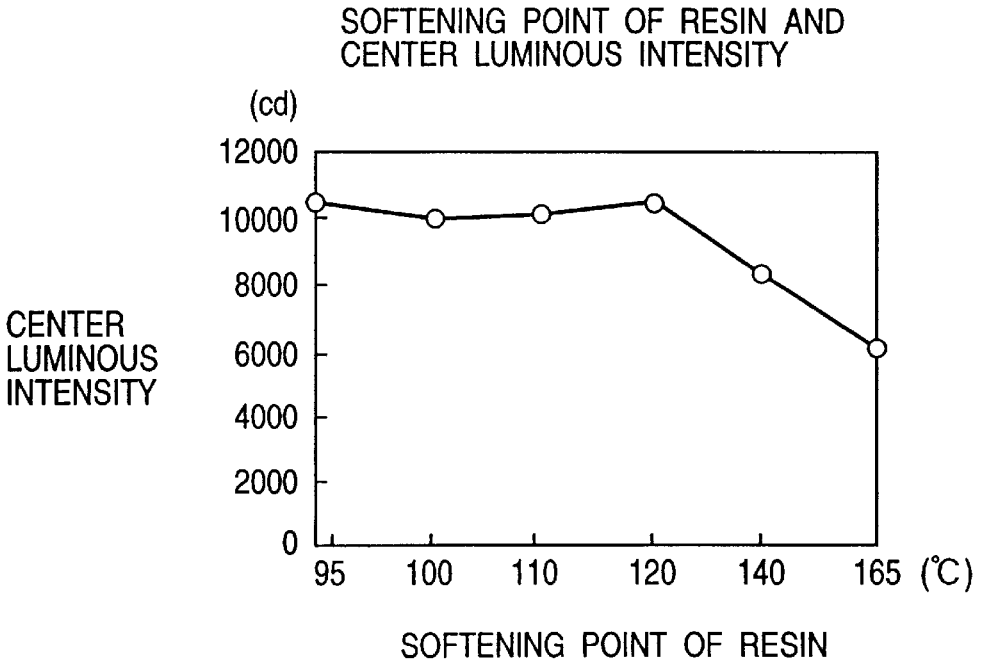
FIG. 5 is graph showing the relation between the softening point of a resin and the center luminous intensity.

Therefore, it is preferred that the softening point of the resin forming the luminance reflective coating film should be 95° C. or higher in view of heat resistance and 140° C. or lower in view of increasing the center luminous intensity (specular reflectance). In order to obtain a center luminous intensity of 10,000 cd or greater, use of a resin having a softening point of 120° C. or higher as a binder is needed as shown in FIG. 5 and when heat resistance against 100° C. is taken into consideration, the softening point of the resin ranging from 100 to 120° C. is desirable.

Although a description has been given of a case where the luminance reflective coating film 30 is formed on the reflector made of ABS, a luminance reflective coating film 30 having the same center luminous intensity may be formed on a reflector made of AAS.

Further, although the adhesion of the petroleum resin as a binder to a reflector base made of PP is inferior to the adhesion thereof to the reflector base of ABS or AAS, the luminance reflective coating film can be formed on the reflector made of PP. In other words, increasing the adhesion of the petroleum resin as a binder to the reflector made of PP can be dealt with by applying a primer coating to the coating surface of the reflector made of PP as a surface treatment before the luminance reflective coating is applied.

The tail lamp has been described in the embodiment of the invention stated above wherein the effective reflective surface of the reflector constituted of the plurality of divided effective reflective surfaces; and the see-through portion is at least provided in part of the front lens 18. However, the present invention is also applicable to a tail lamp such that the effective reflective surface of a reflector is formed with a single parabolic surface and that a step such as a diffusion step is formed over the whole back area of a front lens 18 having no see-through portion.

In addition, solidity is emphasized because this results in improving the external appearance of vehicle lamps since the luminance reflective coated reflector that is seen through the front lens offers greater luminance. Since the luminous intensity of the luminance reflective coated reflector is not greater than that of the aluminum deposited reflector, moreover, any contrivance of decreasing the luminous intensity by applying the smoke top coat to the reflector or forming the emboss and the like can be dispensed with, so that inexpensive lamps can also be provided.

Although the tail lamps have been described in the embodiments of the invention, the application of the present invention is not limited to tail lamps but may include beacon lamps such as stop lamps, turn-signal lamps and clearance lamps, and any other vehicle lamp.

As is obvious from the description given above, a center luminous intensity of 8,000–13,000 cd that has been unobtainable from the prior art reflective coated reflector is obtainable from the luminance reflective coated reflector according to the present invention, which makes it possible to not only broaden the application range of reflective coated reflectors but also reduce lamp production cost by applying lamps (which are based on luminance reflective coated reflector specifications) according to the present invention to those restrictedly based aluminum deposited reflector specifications.

What is claimed is:

1. A vehicle lamp comprising:

a light source;

a reflector disposed behind said light source, for reflecting light from said light source forward; and a front lens disposed in front of said light source, wherein a reflective surface of said reflector is formed with a luminance reflective coating film having a specular reflectance of 45% to 75%, said luminance reflective coating film being formed with aluminum flakes.

2. A vehicle lamp comprising:

a light source;

a reflector disposed behind said light source, for reflecting light from said light source; and a lens disposed in front of said light source, wherein a reflective surface of said reflector is formed with a luminance reflective coating film, said luminance reflective coating film being formed with aluminum flakes, wherein said luminance reflective coating film is coated on a reflector base and includes a binder mixed with said aluminum flakes having a thickness of 0.01–0.06 $\mu$m.

3. A vehicle lamp according to claim 2, wherein said luminance reflective coating has a predetermined viscosity by using a solvent.

4. A vehicle lamp as claimed in claim 3, wherein said binder is a resin having a softening point of in the range from 95 to 140° C.

5. A vehicle lamp as claimed in claim 4, wherein the softening point of the resin is preferably 100–120° C.

6. A vehicle lamp as claimed in claim 2, wherein said lens is provided with a see-through portion through which said reflective surface of said reflector is observable.

7. A method for making a vehicle lamp, comprising the steps of:

providing a lamp body with a bulb fitting hole for fitting a bulb in said bulb fitting hole;

providing a front lens on said lamp body; and integrally forming a reflector on an inside surface of said lamp body for effecting a light distribution of said bulb onto said front lens, wherein said reflector is formed by applying a luminance reflective coating to a reflector base and drying said luminance reflective coating, said luminance reflective coating being prepared by mixing a binder and thin aluminum flakes having a thickness of 0.01–0.06 $\mu$m with stearic acid adhering to the flakes, and adding a volatile solvent to adjust the viscosity to a predetermined level.

8. A vehicle lamp as claimed in claim 2, wherein stearic acid is adhered to said aluminum flakes.

9. A vehicle lamp as claimed in claim 2, wherein said aluminum flakes have a particle size of about 4 $\mu$m.

* * * * *